US010107595B1

(12) United States Patent
Armstrong et al.

(10) Patent No.: US 10,107,595 B1
(45) Date of Patent: Oct. 23, 2018

(54) INDIRECT FIRE MISSION TRAINING SYSTEM

(71) Applicant: Cubic Corporation, San Diego, CA (US)

(72) Inventors: Martyn Armstrong, Salisbury (GB); Neale Smiles, Salisbury (GB); Alastair Parkinson, Wilton (GB); David Boissel, Salisbury (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 15/813,909

(22) Filed: Nov. 15, 2017

Related U.S. Application Data

(60) Provisional application No. 62/522,444, filed on Jun. 20, 2017.

(51) Int. Cl.
*F41G 3/26* (2006.01)
*F41G 3/30* (2006.01)
*F41G 3/02* (2006.01)

(52) U.S. Cl.
CPC ..... *F41G 3/30* (2013.01); *F41G 3/02* (2013.01)

(58) Field of Classification Search
CPC ..... F41G 3/02; F41G 3/30; F41G 3/26; F41A 33/00; F41A 33/02; F41A 33/04; F41A 33/06
See application file for complete search history.

(56) References Cited

U.S. PATENT DOCUMENTS

| | | | | |
|---|---|---|---|---|
| 5,201,658 | A | 4/1993 | Taylor et al. | |
| 6,059,573 | A * | 5/2000 | Patel | F41G 3/30 434/16 |
| 6,193,517 | B1 | 2/2001 | Lazecki | |
| 2009/0081619 | A1 * | 3/2009 | Miasnik | F41A 33/02 434/21 |
| 2014/0373823 | A1 * | 12/2014 | Stevens | F41B 11/71 124/56 |
| 2016/0238344 | A1 | 8/2016 | Jandl et al. | |

OTHER PUBLICATIONS

PCT/US2017/062027 filed Nov. 16, 2017 received an ISR/WO dated Feb. 16, 2018, 12 pages.
Great Britain Patent Application No. 1719241.0, "Search Report" dated May 17, 2018, 3 pages.

* cited by examiner

*Primary Examiner* — Timothy A Musselman
(74) *Attorney, Agent, or Firm* — Kilpatrick Townsend & Stockton LLP

(57) ABSTRACT

A weapon training system for an indirect firing weapon. The weapon training system includes a firing box including at least one processor, and a firing mechanism communicatively coupled with the firing box. Activation of the firing mechanism causes a simulated firing of the indirect firing weapon. The weapon training system also includes a round sensor communicatively coupled with the firing box. The round sensor is operable to be attached to or integrated with a round compatible with the weapon. The round is operable to be inserted into a breech of the weapon. The weapon training system further includes a breech sensor communicatively coupled with the firing box. The breech sensor is configured to detect an insertion of the round into the breech of the weapon via detection of the round sensor.

20 Claims, 8 Drawing Sheets

600

INDIRECT FIRE MISSION TRAINING SYSTEM

CROSS-REFERENCES TO RELATED APPLICATIONS

This application is a nonprovisional of and claims the benefit of priority to U.S. Provisional Patent Application No. 62/522,444, filed Jun. 20, 2017, entitled "INDIRECT FIRE MISSION TRAINING SYSTEM," the content of which is herein incorporated in its entirety.

BACKGROUND OF THE INVENTION

At the individual and team levels, indirect fire training (e.g., artillery, mortar, rockets, grenade launcher, machine gun, etc.) is typically performed using either live ammunition, no ammunition (dry training), or by the use of specialized part task trainers. At the collective training level where the use of live ammunition is constrained by safety, there is currently no ability to link the dry drills on the platform/weapon with the instrumented collective training systems being used tactically in the fields. As a result, whilst the indirect fire system can maneuver in support of training, calls for fire are emulated synthetically without the need for any action by artillery detachment, significantly reducing the training value for all participants. Accordingly, new systems, methods, and other techniques are needed for improving indirect fire training.

SUMMARY OF THE INVENTION

Embodiments described herein may include methods, systems, and other techniques for implementing a weapon training system. The weapon training system may include a firing box including at least one processor. The weapon training system may also include a firing mechanism communicatively coupled with the firing box. In some embodiments, activation of the firing mechanism causes a simulated firing of a weapon. The weapon training system may further include a round sensor communicatively coupled with the firing box. In some embodiments, the round sensor is operable to be attached to or integrated with a round compatible with the weapon. In some embodiments, the round is operable to be inserted into a breech of the weapon. The weapon training system may include a breech sensor communicatively coupled with the firing box. In some embodiments, the breech sensor is configured to detect an insertion of the round into the breech of the weapon via detection of the round sensor.

In some embodiments, the weapon training system includes at least one charge sensor communicatively coupled with the firing box. In some embodiments, the at least one charge sensor is operable to be attached to or integrated with at least one charge compatible with the weapon. In some embodiments, the at least one charge is operable to be inserted into the breech of the weapon. In some embodiments, the breech sensor is configured to detect an insertion of the at least one charge into the breech of the weapon via detection of the at least one charge sensor. In some embodiments, detection of the at least one charge sensor is indicative of a charge quantity or a charge type associated with the at least one charge. In some embodiments, the weapon training system includes a speaker communicatively coupled with the firing box. In some embodiments, in response to the activation of the firing mechanism causing the simulated firing of the weapon, the speaker is configured to output an audio signal. In some embodiments, the audio signal is dependent on one or more of the weapon, the round, the charge type, and the charge quantity.

In some embodiments, the weapon training system includes an orientation sensor communicatively coupled with the firing box. In some embodiments, the orientation sensor is operable to be attached to or integrated with the weapon. In some embodiments, the orientation sensor is configured to determine an orientation of the weapon. In some embodiments, the weapon training system includes a Global Navigation Satellite System (GNSS) sensor communicatively coupled with the firing box, the GNSS sensor operable to be attached to or integrated with the weapon. In some embodiments, the GNSS sensor is configured to determine a geospatial position of the weapon. In some embodiments, the weapon training system includes an evaluator device communicatively coupled with the firing box. In some embodiments, the evaluator device is configured to display an analysis of a training protocol associated with the simulated firing of the weapon. In some embodiments, the analysis of the training protocol includes one or more of: an indication that the firing mechanism was activated, an indication that the simulated firing of the weapon occurred, an indication that each of one or more requirements of the training protocol were met, and an indication that one or more requirements of the training protocol were not met.

In some embodiments, the weapon training system includes a fuse setter communicatively coupled with one or both of the firing box and the round sensor. In some embodiments, the fuse setter is configured to modify a fuse setting associated with a fuse of the round. In some embodiments, the firing mechanism includes one or more of: a button, a knob, a switch, a lever, a pull cord, and a touch screen. In some embodiments, the firing mechanism is integrated with the firing box. In some embodiments, the firing box is operable to be attached to the weapon. In some embodiments, the breech sensor is integrated with the firing box. In some embodiments, the firing box is operable to be attached to the weapon within a threshold distance of the breech of the weapon.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
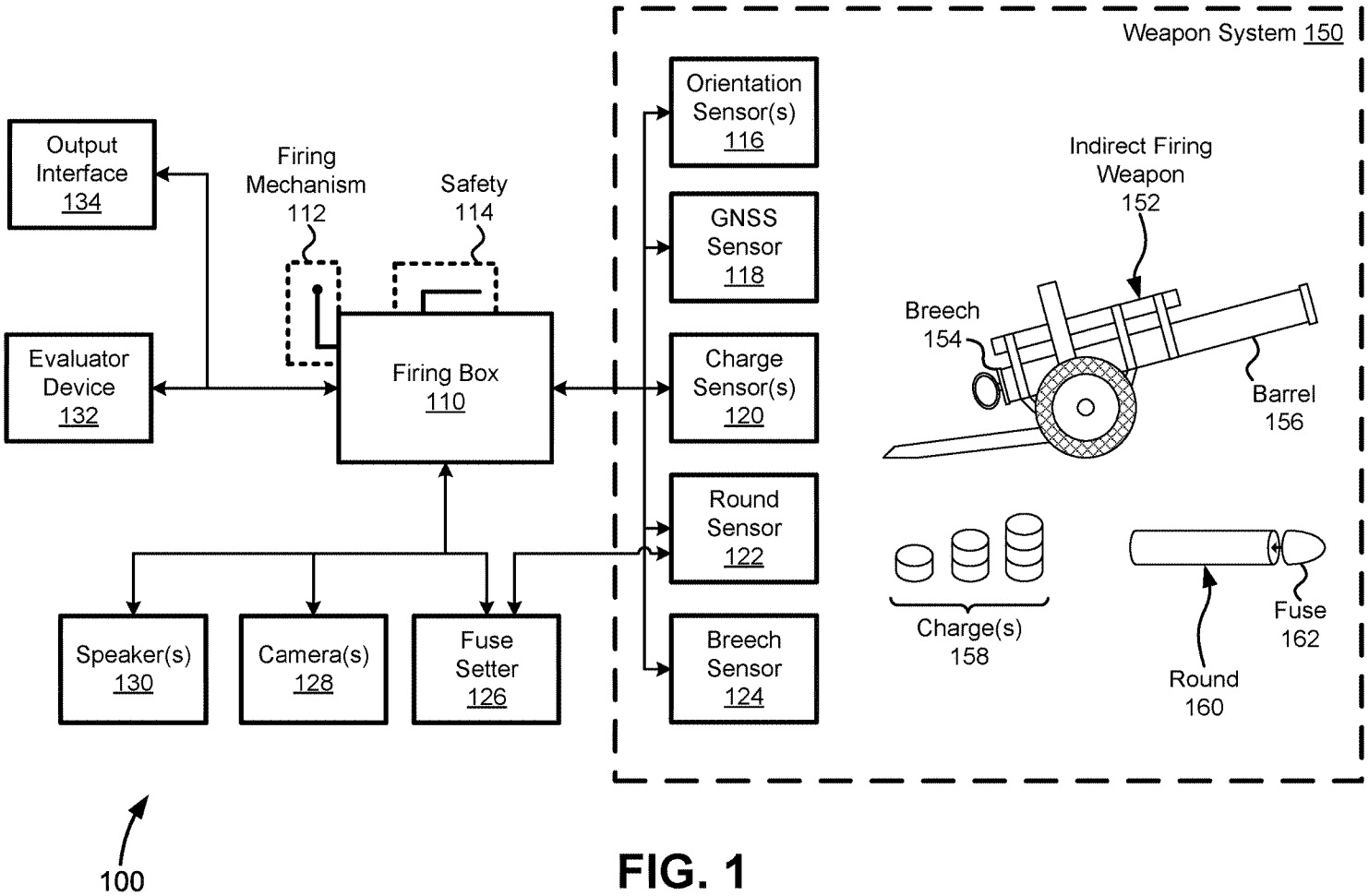
FIG. 1 shows an example of a weapon training system, according to some embodiments of the present disclosure.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION OF THE INVENTION

Various specific embodiments will be described below with reference to the accompanying drawings constituting a part of this specification. It should be understood that, although structural parts and components of various examples of the present disclosure are described by using terms expressing directions, e.g., "front", "back", "upper", "lower", "left", "right" and the like in the present disclosure, these terms are merely used for the purpose of convenient description and are determined on the basis of exemplary directions displayed in the accompanying drawings. Since the embodiments disclosed by the present disclosure may be set according to different directions, these terms expressing directions are merely used for describing rather than limiting. Under possible conditions, identical or similar reference numbers used in the present disclosure indicate identical components.

Embodiments of the present disclosure relate to a weapon training system. The disclosed weapon training system provides an alternative to live fire training and dry fire training, which have significant drawbacks. For example, live fire training is expensive, damaging to the environment, and does not provide a realistic experience for down range infantry, which must remain a significant distance away from any potential firing zones for regulatory and safety reasons. On the other hand, dry fire training does not allow an artillery detachment to go through all the actions of a firing protocol, which significantly reduces the training value. Furthermore, dry fire training does not provide a means of determining whether a firing protocol was followed aside from an instructor having to check each individual action visually, at each stage of the firing drills. Dry fire training also does not monitor whether a potential firing zone was properly targeted.

The weapon training system described herein allows detachments to conduct the correct drills on a weapon/platform and for those drills to be captured electronically as part of a wider live, virtual, and constructive training system. The data from the indirect fire mission training system may be used to train personnel and ensure they are competent and current. The data may also be entered into an existing live, virtual, and constructive training domain thereby enabling the integration of the indirect fire platform into the collective training system. In some instances, the data is logged for training review and input into training records for accreditation. Real-time analysis of the weapon training may be presented on an evaluator device used by an instructor. The evaluator device may indicate whether one or more requirements of a training protocol are being met, and may compare the current weapon training to system wide averages or benchmarks.

The weapon training system described herein allows gun detachments to use in service equipment to conduct the complete range of drills required for training and to maintain competency and currency. Detachments are able to load ammunition with all elements of the indirect fire system instrumented to capture and record the actions taken to ensure they are correct. For example, detachments are able to load actual or imitation rounds into an actual indirect firing weapon, and for those rounds to remain stacked in the barrel until deliberately unloaded. The evaluator device allows an instructor to monitor visually and/or electronically the actions of the detachment to ensure the correct loading and firing protocols are being followed. Through the same interface, the instructor may insert faults for the detachment to address.

Using Distributive Interactive Simulation (DIS) and/or high-level architecture (HLA), the outputs of the system may enable the drills at the gun position to be interactive with other drills conducted within the wider constructive training system. For example, the gun position may be maneuvered to support friendly forces and to avoid enemy forces. The weapon training system may represent the effects of enemy indirect fire (counter battery) on the position by playing an acoustic cue over the same speakers which are used to represent firing. At the target end, friendly and/or enemy forces may experience the effects of the simulated firing, such as a notification of simulated injury and/or death. The detachment at the gun position may receive communication from down range friendly forces of locations of possible enemy forces, which may be subsequently targeted by modifying a gun bearing, elevation, trunnion tilt, charge type, charge quantity, fuse, and/or ammunition type associated with the indirect firing weapon.

FIG. 1 shows an example of a weapon training system 100, according to some embodiments of the present disclosure. In one implementation, weapon training system 100 allows one or more individuals in a detachment to train using a weapon system 150 which may include an indirect firing weapon 152, charge(s) 158, and round 160. Indirect firing weapon 152 may be any one of a wide range of weapons that fire a projectile without relying on a direct line of sight between the weapon and the target, including, but not limited to: an artillery, a tank, a mortar, a rocket, a rocket launcher, a grenade launcher, a heavy machine gun, a naval gun, and the like. Indirect firing weapon 152 may be an actual weapon capable of firing live rounds or an imitation weapon manufactured for purposes of weapon training system 100, among other possibilities.

Round 160 may be any type of projectile that is propelled toward a target in response to ignition of charge(s) 158. In some embodiments, round 160 may be integrated with charge(s) 158 such that round 160 and charge(s) 158 are both enclosed by a partially metal casing. Round 160 may be compatible with indirect firing weapon 152 such that round 160 may be inserted into a breech 154 at one end of a barrel 156 of indirect firing weapon 152. Accordingly, round 160 may have a diameter equal to or less than an inner diameter of barrel 156. In some embodiments, round 160 is an inexpensive, safe imitation of that described above such that round 160 may have similar size, weight, and/or dimensions of an actual round.

Round 160 may include a fuse 162 that is attached to or integrated with the body of round 160. Fuse 162 may be a programmable device capable of igniting round 160 at a specific time based on an elapsed time from being fired from indirect firing weapon 152 or based on a distance from a target, among other possibilities. For example, fuse 162 may be configured to ignite round 160 when round 160 is approximately 50 feet from reaching a target. As another example, fuse 162 may be configured to ignite round 160 at approximately one second after hitting a target. In some embodiments, fuse 162 is an inexpensive, safe imitation of that described above such that fuse 162 may have similar size, weight, and/or dimensions of an actual fuse.

Charge(s) 158 may include any type of explosive used as a propellant to propel round 160 toward a target. Charge(s) 158 may be a low explosive that deflagrates but does not detonate. Charge(s) 158 may be compatible with indirect firing weapon 152 such that charge(s) 158 may be inserted into breech 154 and such that the force caused by ignition of charge(s) 158 is less than a capacity of barrel 156. Charge(s) 158 may vary in type (i.e., charge type) and/or may vary in the number of charge(s) 158 (i.e., charge quantity) that are inserted into breech 154. For example, a first round 160 may require two five-pound bags of charge 158 of type A, a second round 160 may require one five-pound bag of charge 158 of type A, and a third round 160 may require one five-pound bag of charge 158 of type B. In some embodiments, charge(s) 158 is an inexpensive, safe imitation of that described above such that charge(s) 158 may have similar size, weight, and/or dimensions of an actual charge.

Weapon training system 100 may include various components that are communicatively coupled with each other, including but not limited to, a firing box 110, a firing mechanism 112, a safety 114, an orientation sensor(s) 116, a Global Navigation Satellite System (GNSS) sensor 118, a charge sensor(s) 120, a round sensor 122, a breech sensor 124, a fuse setter 126, a camera(s) 128, a speaker(s) 130, an evaluator device 132, and an output interface 134. In some embodiments, firing box 110 acts as a central receiver and processor of data generated by each of the listed components. In some embodiments, data generated by each of the listed components are transmitted directly to firing box 110 using one or more communication techniques. In some embodiments, data generated by one or more of the listed components are first communicated via one or more different components prior to being received by firing box 110. Communication techniques employed by the listed components may include one or more of: Bluetooth®, Bluetooth® Low Energy (LE), Wi-Fi, Institute of Electrical and Electronics Engineers (IEEE) 802.11, Worldwide Interoperability for Microwave Access (WiMAX), Long-Term Evolution (LTE), 3G, 4G, free-space optical communication, optical fiber, wired communication, Universal Serial Bus (USB), and the like.

Firing box 110 may be configured to receive and process data generated by the various components of FIG. 1. Firing box 110 may include one or more processors and one or more storage devices. In some embodiments, firing box 110 comprises a physical box that may be attached to indirect firing weapon 152 so that it may be easily accessed by individuals of a firing detachment. In some instances, firing box 110 is placed such that is covers and imitates an actual firing mechanism of indirect firing weapon 152. Firing mechanism 112 may be communicatively coupled with firing box 110 and/or integrated with firing box 110. For example, firing mechanism 112 may protrude out from firing box 110. In some embodiments, firing mechanism 112 may comprise one or more of a button, a knob, a switch, a lever, a pull cord, and a touch screen. Activation of firing mechanism 112 (due to, e.g., pressing the button, rotating the knob, flipping the switch, etc.) may cause a simulated firing of indirect firing weapon 152. In response to activation, firing mechanism 112 may send data to firing box 110 indicating the activation. Safety 114 may be communicatively coupled with firing box 110 and/or integrated with firing box 110, and may be configured to prevent activation of firing mechanism 112.

Orientation sensor(s) 116 may be communicatively coupled with firing box 110 and may, in some embodiments, be attached to or integrated with indirect firing weapon 152. Orientation sensor(s) 116 may include one or more accelerators and/or one or more gyroscopes for determining an orientation of indirect firing weapon 152, which may correspond to an orientation of barrel 156. The orientation of indirect firing weapon 152 may be a three-dimensional value or, in some embodiments, may be a single value corresponding to an angle formed by barrel 156 and the ground or an elevation of barrel 156. In some embodiments, orientation sensor(s) may monitor the bearing, elevation, and trunnion tilt of a weapon platform. In one implementation, orientation sensor(s) includes a rechargeable power source and communicates data (e.g., the orientation of indirect firing weapon 152) to firing box 110 via Bluetooth® LE.

GNSS sensor 118 may be communicatively coupled with firing box 110 and may, in some embodiments, be attached to or integrated with indirect firing weapon 152. GNSS sensor 118 may be configured to determine a geospatial position of indirect firing weapon 152, which may correspond to a geospatial position of barrel 156. GNSS sensor 118 may comprise a GNSS receiver configured to receive wireless signals transmitted by one or more satellites, and may perform a trilateration technique to determine a three-dimensional or two-dimensional geospatial position of indirect firing weapon 152. A three-dimensional geospatial position may comprise X, Y, and Z values or may comprise longitude, latitude, and elevation values, among other possibilities. A two-dimensional geospatial position may comprise X and Y values or may comprise longitude and latitude values, among other possibilities.

In response to activation of firing mechanism 112, firing box 110 may receive/retrieve/obtain data from orientation sensor(s) 116 and GNSS sensor 118 (either in raw form or processed form), along with data from other sensors. Firing box 110 may then determine one or more of: a geospatial position of indirect firing weapon 152, an orientation of indirect firing weapon 152, a trajectory of a fired round and an area of damage associated with a fired round, and the like. The determined trajectory of the fired round may be based on the geospatial position, the orientation, and the exit velocity of round 160 (which may be determined based on round 160 and charge(s) 158 as determined by charge sensor(s) 120 and round sensor 122). In some embodiments, the determined trajectory may be calculated using classical mechanics equations and/or lookup tables stored in firing box 110. For example, the exit velocity may be determined using lookup tables, and the trajectory of the fired round may be determined based on a classical mechanics equation having at least three variables: position, orientation, and exit velocity.

Charge sensor(s) 120 may be communicatively coupled with firing box 110 and may, in some embodiments, be attached to or integrated with charge(s) 158. Charge sensor(s) 120 may be encoded with information that identifies a charge type and/or a charge quantity associated with charge(s) 158. For example, charge sensor(s) 120 may comprise active or passive radio-frequency identification (RFID) tags that are attached to charge(s) 158, and detection of charge sensor(s) 120 by breech sensor 124 may allow breech sensor 124 to determine the charge type and/or charge quantity. In some embodiments, charge sensor(s) 120 may communicate data indicative of charge type and/or charge quantity to firing box 110 directly. In other embodiments (or in the same embodiments), charge sensor(s) 120 may communicate data indicative of charge type and/or charge quantity to breech sensor 124, which may communicate the data to firing box 110. In one implementation, charge(s) 158 are imitations of actual charges and are integrated with charge sensor(s) 120. Such integration may provide a safer and inexpensive alternative for a firing detachment who wish to train using weapon training system 100 without actual explosives. However, in some implementations in which more realism is needed, charge(s) 158 may comprise actual explosives and charge sensor(s) 120 may be attached externally to charge(s) 158.

Round sensor 122 may be communicatively coupled with firing box 110 and may, in some embodiments, be attached to or integrated with round 160. For example, round sensor 122 may be attached to fuse 162, integrated with fuse 162, attached to the body of round 160 (portions of round 160 that is not fuse 162), and/or integrated with the body of round 160. Round sensor 122 may be encoded with information that identifies a round type (e.g., high explosive, low explosive, smoke, napalm, etc.). In some embodiments, round sensor 122 is encoded with information that identifies a fuse setting associated with fuse 162. The fuse setting may be programmed by another device (e.g., fuse setter 126) and may include an amount of time after the simulated firing of indirect firing weapon 152 until a simulated ignition, a distance traveled after the simulated firing of indirect firing weapon 152 until a simulated ignition, a time from reaching a target, a distance from hitting a target, a time after reaching a target, and the like. In some embodiments, round sensor 122 may communicate data indicative of round type and/or the fuse setting to firing box 110 directly. In other embodiments (or in the same embodiments), round sensor 122 may communicate data indicative of round type and/or the fuse setting to breech sensor 124, which may communicate the data to firing box 110.

Breech sensor 124 may be communicatively coupled with firing box 110 and may, in some embodiments, be attached to or integrated with indirect firing weapon 152. In some embodiments, breech sensor 124 is attached to indirect firing weapon 152 near (within a threshold distance of) breech 154 such that breech sensor 120 may detect an insertion of round 160 and/or charge(s) 158 into breech 154 by detecting round sensor 122 and/or charge sensor(s) 120, respectively. In some embodiments, breech sensor 124 may comprise a distance sensor and may determine that round 160 or charge(s) 158 have been inserted into breech 154 when the detected distance between breech sensor 124 and round sensor 122 or charge sensor(s) 120 is below a predetermined threshold (e.g., 0.25 meters). For example, in one implementation breech sensor 124 may comprise an RFID reader and round sensor 122 and/or charge sensor(s) 120 may comprise RFID tags. In some embodiments, breech sensor 124 may comprise a direction sensor and may determine that round 160 or charge(s) 158 have been inserted into breech 154 when the detected direction of round sensor 122 or charge sensor(s) 120 with respect to breech sensor 124 is such that a position of round sensor 122 or charge sensor(s) 120 must be inside barrel 156.

In one implementation, breech sensor 124 monitors and transmits the state of breech 154 (e.g., open, partially open, closed) using a radio frequency (RF) signal. In a power saving mode, breech sensor 124 may be configured to turn off when breech 154 is closed and to turn on when breech 154 is open, as there is no need to scan for round sensor 122 and/or charge sensor(s) 120 when breech 154 is closed. In such embodiments, breech 154 may trigger an on/off switch associated with breech sensor 124 as it is opened or closed. In one implementation, breech sensor 124 has a rechargeable power source.

Fuse setter 126 may be communicatively coupled with firing box 110 and/or round sensor 122 and may be configured to modify the fuse setting associated with fuse 162. In some embodiments fuse setter 126 comprises a mechanical device (e.g., a switch) with a discrete set of options for the fuse setting. In some embodiments, fuse setter 126 is integrated with fuse 162. In some embodiments, fuse setter 126 covers and imitates an actual fuse setter of indirect firing weapon 152. In some embodiments, fuse setter 126 determines the current fuse setting and outputs it to a user via, for example, a graphical user interface (GUI). The GUI may also be used to modify the current fuse setting. In one implementation, fuse setter 126 has a rechargeable power source.

Camera(s) 128 may be communicatively coupled with firing box 110 and may, in some embodiments, be attached to or integrated with indirect firing weapon 152. In some embodiments, camera(s) 128 are positioned such that they capture the actions performed by the firing detachment. Video and images captured by camera(s) 128 may be transmitted, through a wired or wireless connection, to firing box 110 and/or to evaluator device 132 such that the actions performed by the firing detachment may be evaluated by an instructor. In some implementations, multiple cameras positioned at various positions and angles near (or distant to) indirect firing weapon 152 may be used. Additionally, camera(s) 128 may be positioned near the target end such that a firing detachment may determine locations of friendly and/or enemy forces.

Speaker(s) 130 may be communicatively coupled with firing box 110 and may, in some embodiments, be attached to or integrated with indirect firing weapon 152. In response to the simulated firing of indirect firing weapon 152, speaker(s) 130 may be configured to output an audio signal indicative of a weapon firing. The audio signal may be dependent on several factors, including indirect firing weapon 152, the round type, the charge type, and the charge quantity. In some embodiments, audio files associated with each possible combination of weapons, round types, charge types, and charge quantities may be stored in firing box 110 and retrieved when a simulated firing occurs. In some embodiments, speaker(s) 130 may also be configured to output an audio signal indicative of enemy direct and/or indirect fire on the firing position. Furthermore, the audio signal may also include information indicative of a training mission, such as the time remaining or when the training mission has ended.

Evaluator device 132 may be communicatively coupled with firing box 110 and may be configured to retrieve data generated by one or more of the various components of weapon training system 100. In some instances, evaluator device 132 is used by an instructor to monitor the actions of the firing detachment to ensure correct firing protocols are being followed. In some embodiments, evaluator device 132 includes a digital display with a GUI configured to display images and video captured using camera(s) 128, as well as an analysis of a training protocol and other statistics. An analysis of a training protocol may include one or more of:

an indication that firing mechanism 112 was activated, an indication that the simulated firing of indirect firing weapon 152 occurred, an indication that each of one or more requirements of the training protocol were met, and an indication that one or more requirements of the training protocol were not met.

In some embodiments, an instructor may introduce faults into a training mission using evaluator device 132. For example, an instructor may select an option using a GUI that causes a simulated malfunction of indirect firing weapon 152. The evaluator device 132 may display the requirements that need to be met in order to resolve the weapon malfunction as well as an indication whether each of the requirements have been met. In some embodiments, the instructor may use evaluator device 132 to communicate with the firing detachment, who may want to give preliminary instructions prior to the start of a training mission, or give feedback during or after completion of a training mission. For example, audio communications may be received/recorded using evaluator device 132 and may be outputted by speaker(s) 130 positioned near the firing detachment. In one implementation, evaluator device 132 displays the general state of indirect firing weapon 152 for the instructor. The general state of indirect firing weapon 152 may include a geospatial position of the weapon, an orientation of the weapon, a temperature of the weapon, a health of the weapon, a number of rounds fired, a number of targets hit, a number of targets missed, an accuracy of the weapon (e.g., average distance from target to location where round hit).

In some embodiments, information generated by weapon training system 100 may be outputted to external systems using an output interface 134. In some embodiments, output interface 134 may utilize DIS and/or HLA. Outputs of weapon training system 100 may include one or more of: a trajectory of a fired round, a fuse setting for a fired round, a type of round, an area of damage associated with a fired round, an indication that indirect firing weapon 152 has been destroyed, an indication that the firing detachment associated with indirect firing weapon 152 has been eliminated, a communication from the firing detachment to down range friendly forces, and the like. Outputs of weapon training system 100 may also include overall results from the training mission, such as mission success, mission failure, the number of objectives completed, and the like. In some embodiments, weapon training system 100 may also receive data from external systems via output interface 134. In one implementation, output interface 134 employs LTE technology.

Figure 2:
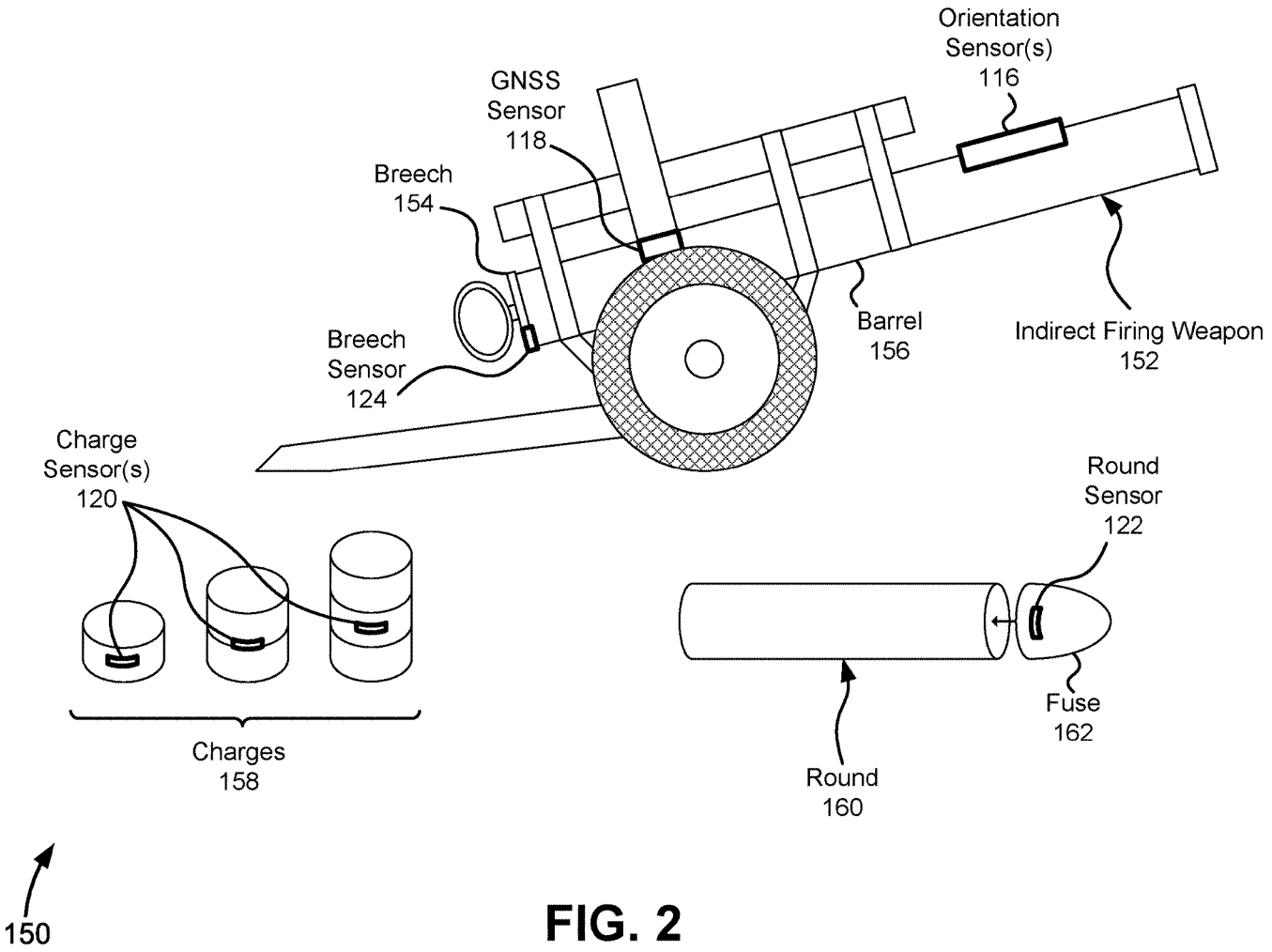
FIG. 2 shows an example of a weapon system having various attached sensors, according to some embodiments of the present disclosure.

FIG. 2 shows an example of weapon system 150 having various attached sensors, according to some embodiments of the present disclosure. In the implementation shown in FIG. 2, orientation sensor(s) 116 is attached to barrel 156 in the longitudinal direction such that a portion of orientation sensor(s) 116 may be aligned with barrel 156. In the implementation shown, GNSS sensor 118 is attached to indirect firing weapon 152 near barrel 156, and breech sensor 124 is attached to a bottom side of breech 154. In the implementation shown, charge sensor(s) 120 are attached to an outer side of charges 158, and round sensor 122 is attached to an outer side of fuse 162. Other implementations are possible.

Figure 3A:
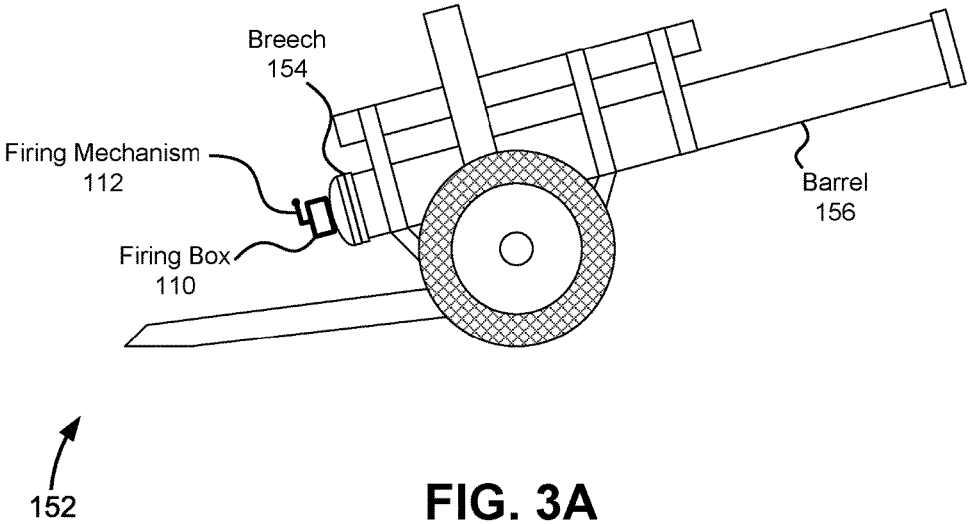
FIG. 3A shows an example of an indirect firing weapon, according to some embodiments of the present disclosure.

FIG. 3A shows an example of an indirect firing weapon 152, according to some embodiments of the present disclosure. In the implementation shown in FIG. 3A, firing box 110 having firing mechanism 112 is attached to the door of breech 154 so as to emulate an actual firing mechanism 112 positioned on the door of breech 154. In some embodiments, firing box 110 may be attached via a magnetic, adhesive, and/or mechanical connection to the door of breech 154.

Figure 3B:
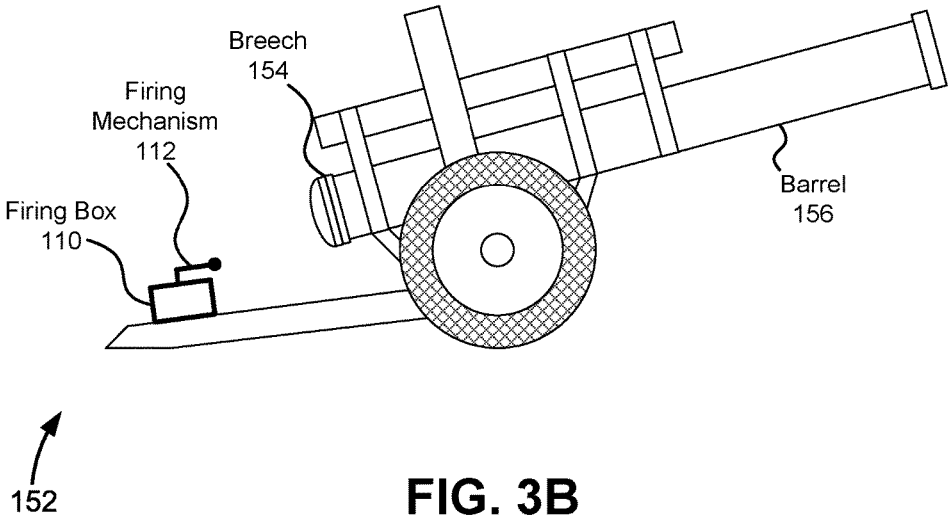
FIG. 3B shows an example of an indirect firing weapon, according to some embodiments of the present disclosure.

FIG. 3B shows an example of an indirect firing weapon 152, according to some embodiments of the present disclosure. In the implementation shown in FIG. 3B, firing box 110 having firing mechanism 112 is attached to the leg of indirect firing weapon 152 so as to emulate an actual firing mechanism 112 positioned on the leg of indirect firing weapon 152.

Figure 4A:
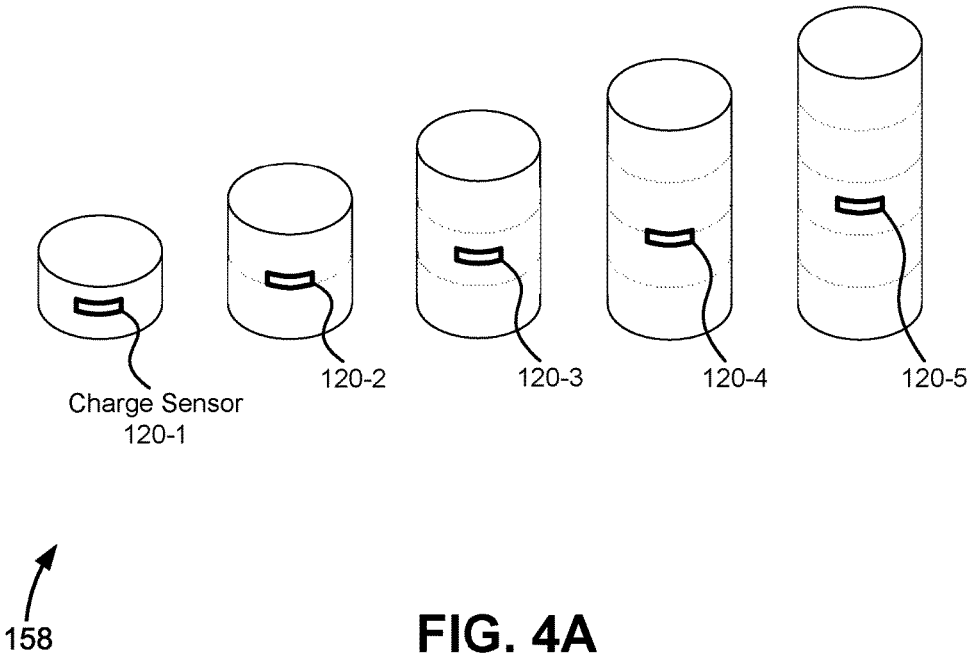
FIG. 4A shows an example of various charges that are compatible with an indirect firing weapon, according to some embodiments of the present disclosure.

FIG. 4A shows an example of various charges 158 that are compatible with an indirect firing weapon 152, according to some embodiments of the present disclosure. In the implementation shown in FIG. 4A, a charge sensor 120-1 indicating a charge quantity of one is attached to a charge bag containing one charge, a charge sensor 120-2 indicating a charge quantity of two is attached to a charge bag containing two charges, a charge sensor 120-3 indicating a charge quantity of three is attached to a charge bag containing three charges, a charge sensor 120-4 indicating a charge quantity of four is attached to a charge bag containing four charges, and a charge sensor 120-5 indicating a charge quantity of five is attached to a charge bag containing five charges. Each of charge sensors 120 may also indicate a charge type. In this manner, detection of a single charge sensor 120 by breech sensor 124 may indicate a charge quantity and a charge type.

Figure 4B:
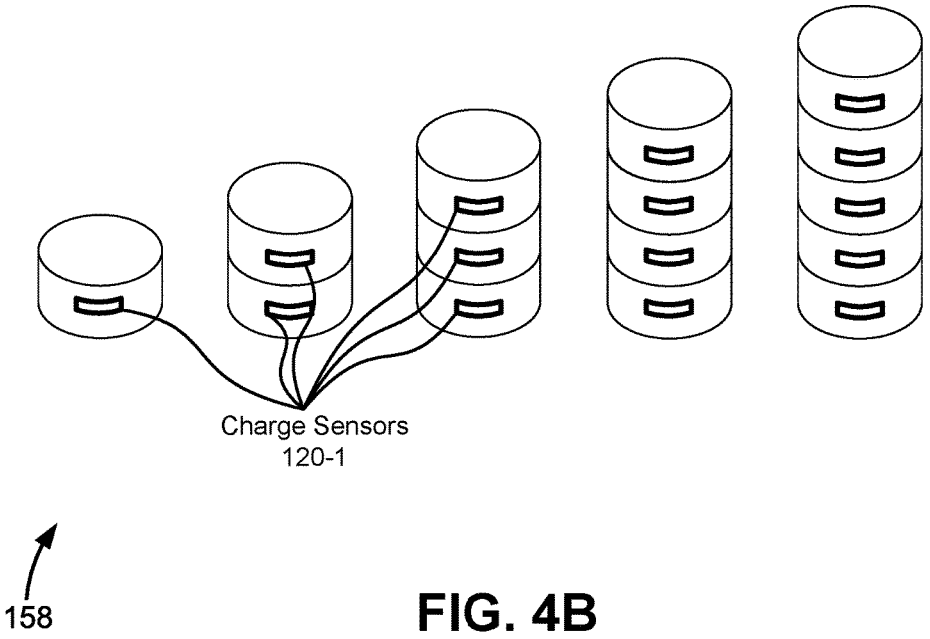
FIG. 4B shows an example of various charges that are compatible with an indirect firing weapon, according to some embodiments of the present disclosure.

FIG. 4B shows another example of various charges 158 that are compatible with an indirect firing weapon 152, according to some embodiments of the present disclosure. In the implementation shown in FIG. 4B, charge sensor 120-1 indicating a charge quantity of one is attached to each charge bag. When a particular training mission requires larger charge quantities, multiple charge bags may be inserted into breech 154. Each of charge sensors 120-1 may also indicate a charge type. In this manner, detection of multiple charge sensors 120-1 by breech sensor 124 may indicate a charge quantity and a charge type.

Figure 5A:
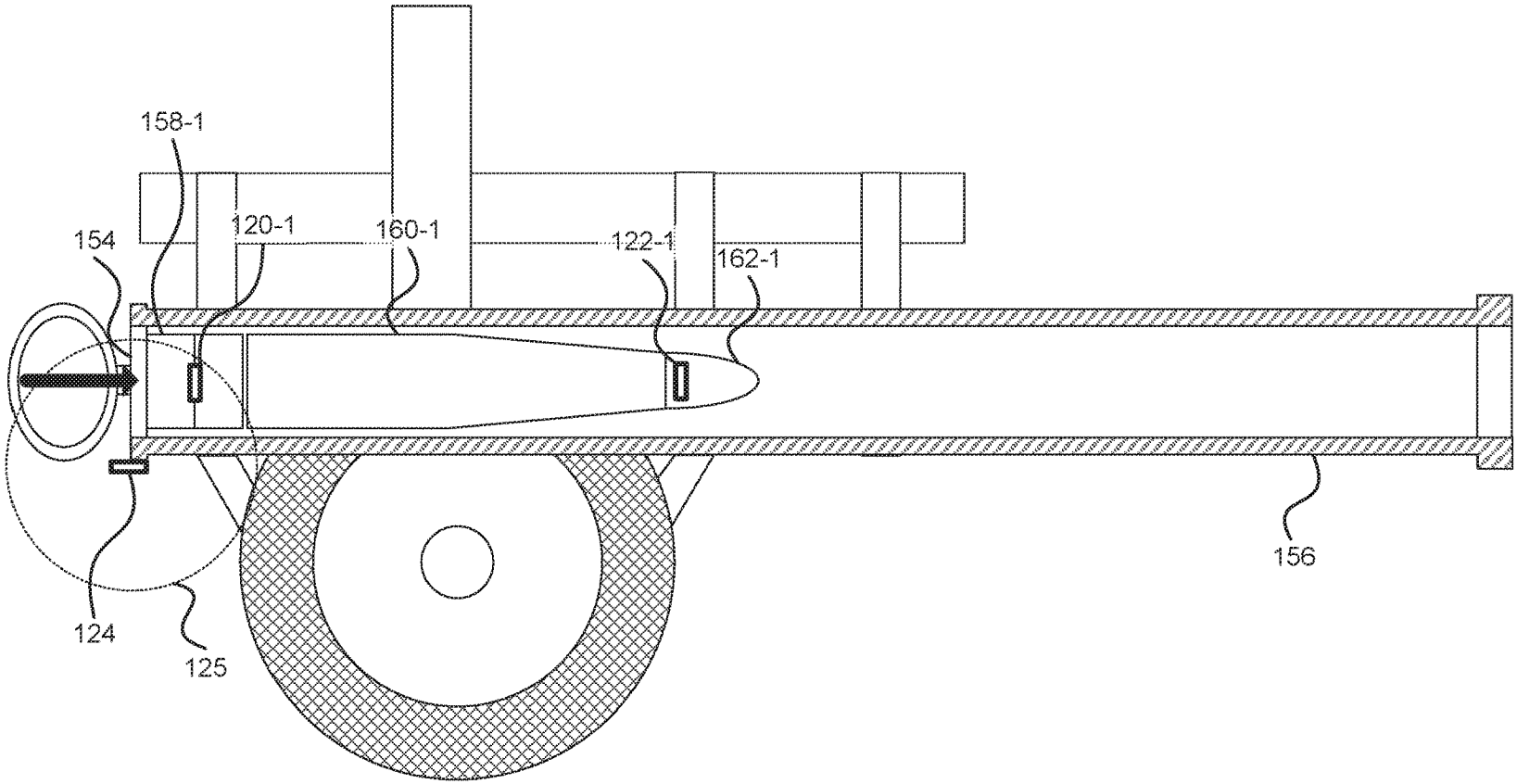
FIGS. 5A-5C shows various stages of loading an indirect firing weapon, according to some embodiments of the present disclosure.
Figure 5B:
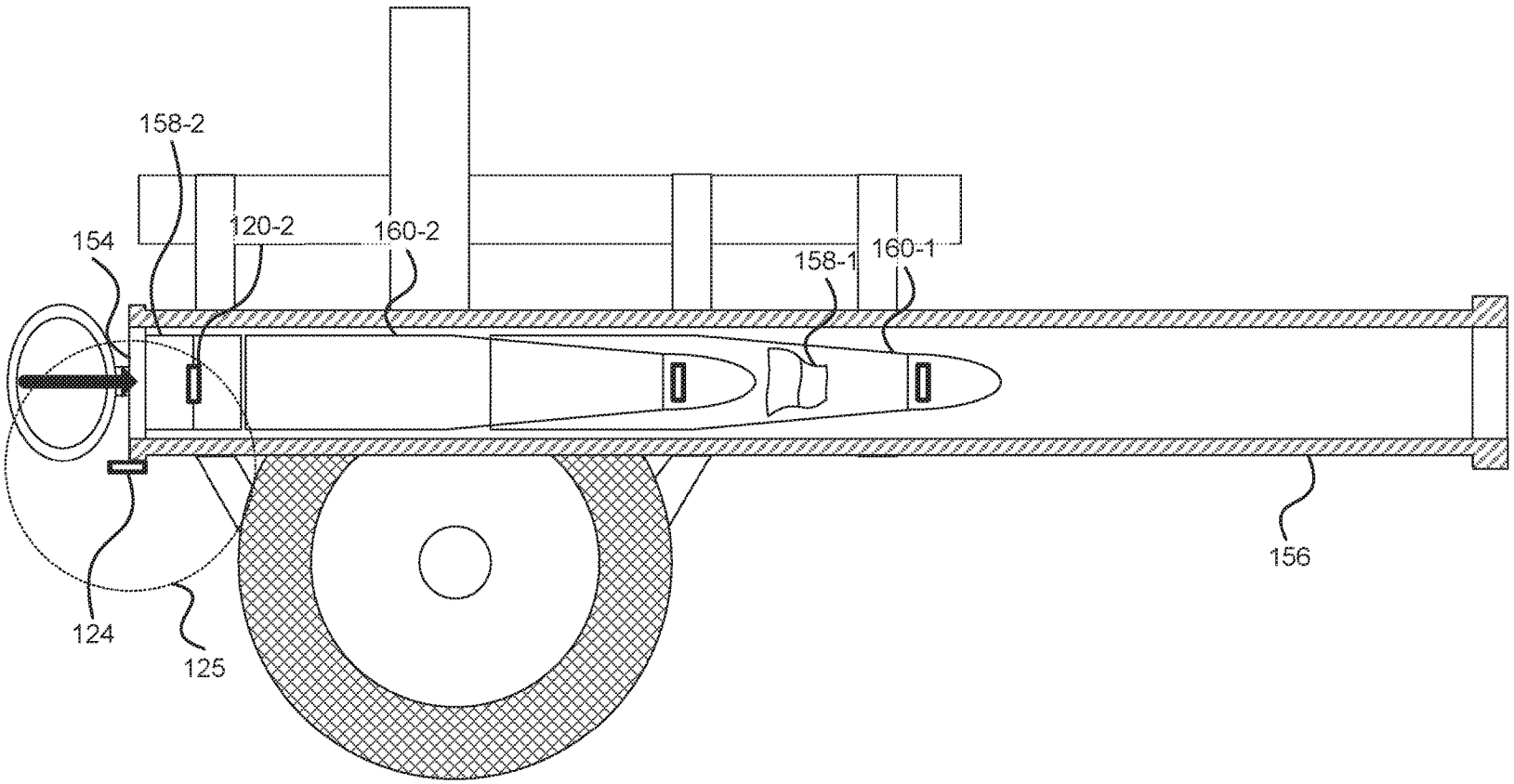
Figure 5C:
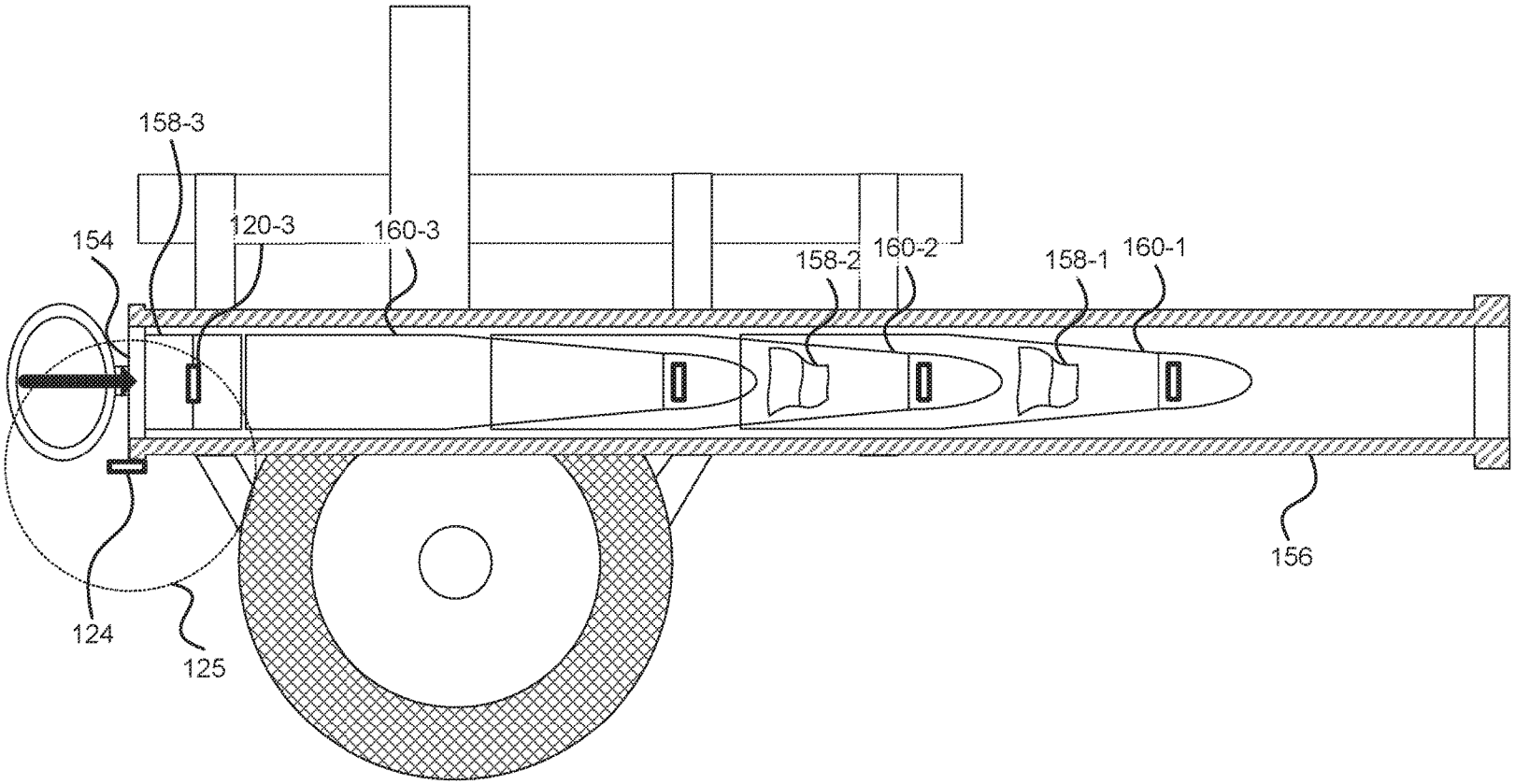

FIGS. 5A-5C shows various stages of loading an indirect firing weapon 152, according to some embodiments of the present disclosure. In reference to FIG. 5A, a first round 160-1 and a first charge 158-1 are sequentially inserted into breech 154 and are detected by breech sensor 124 having a detection zone 125. In the implementation shown, first round 160-1 and first charge 158-1 are an imitation round and imitation charge, respectively. For example, first round 160-1 may be hollowed and open at the base end such that an additional round may be inserted into first round 160-1 and may lock in place. Furthermore, first charge 158-1 may be collapsible such that it may be partially flattened and pushed into the opening at the base end of first round 160-1 when the additional round is inserted. First charge 158-1 may be composed of a collapsible material (e.g., foam, inflatables, etc.), and may cause a first charge sensor 120-1 attached to or integrated with first charge 158-1 to be destroyed (or preserved) upon collapse of first charge 158-1.

In reference to FIG. 5B, a second round 160-2 and a second charge 158-2 are sequentially inserted into breech 154 and are detected by breech sensor 124, causing insertion of second round 160-2 into first round 160-1 and collapse of first charge 158-1. In the implementation shown, second round 160-2 and second charge 158-2 are an imitation round and imitation charge, respectively, similar to first round 160-1 and first charge 158-1. In reference to FIG. 5C, a third round 160-3 and a third charge 158-3 are sequentially inserted into breech 154 and are detected by breech sensor 124, causing insertion of third round 160-3 into second round 160-2 and collapse of second charge 158-2. In the implementation shown, third round 160-3 and third charge 158-3 are an imitation round and imitation charge, respectively, similar to first round 160-1 and first charge 158-2. After completion of a training mission, one or more rounds and charges may be removed from barrel 156 by inserting an extractor mechanism. In some embodiments, extractor mechanism is shaped similar to the inserted rounds so that it may inserted and locked into the last inserted round, allowing removal of all inserted rounds. In other embodiments (or in the same embodiments), inserted rounds are removed one at a time using the extractor mechanism.

Figure 6:
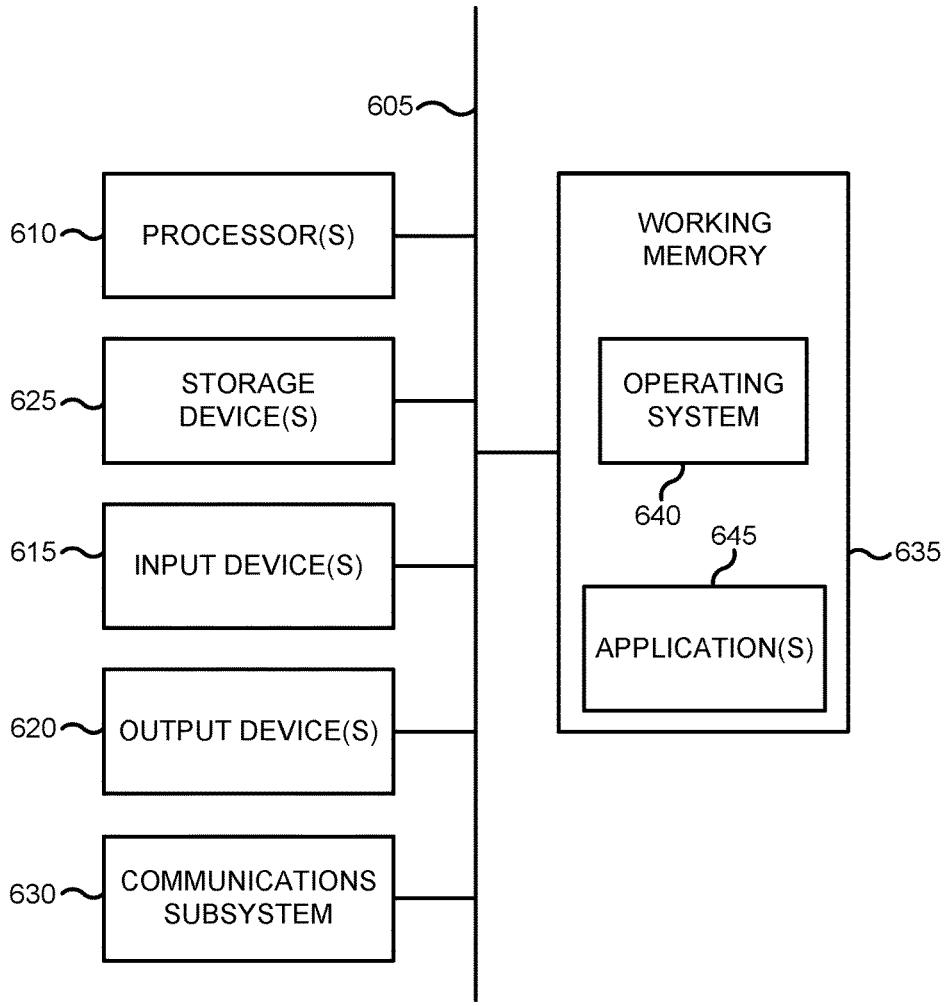
FIG. 6 shows an example of a simplified computer system, according to some embodiments of the present disclosure.

FIG. 6 shows an example of a simplified computer system 600, according to some embodiments of the present disclosure. A computer system 600 as illustrated in FIG. 6 may be incorporated into devices such as firing box 110, orientation sensor(s) 116, GNSS sensor 118, charge sensor(s) 120, round sensor 122, breech sensor 124, fuse setter 126, and evaluator device 132. FIG. 6 provides a schematic illustration of one embodiment of a computer system 600 that can perform some or all of the steps of the methods provided by various embodiments. It should be noted that FIG. 6 is meant only to provide a generalized illustration of various components, any or all of which may be utilized as appropriate. FIG. 6, therefore, broadly illustrates how individual system elements may be implemented in a relatively separated or relatively more integrated manner.

The computer system 600 is shown comprising hardware elements that can be electrically coupled via a bus 605, or may otherwise be in communication, as appropriate. The hardware elements may include one or more processors 610, including without limitation one or more general-purpose processors and/or one or more special-purpose processors such as digital signal processing chips, graphics acceleration processors, and/or the like; one or more input devices 615, which can include without limitation a mouse, a keyboard, a camera, and/or the like; and one or more output devices 620, which can include without limitation a display device, a printer, and/or the like.

The computer system 600 may further include and/or be in communication with one or more non-transitory storage devices 625, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The computer system 600 might also include a communications subsystem 630, which can include without limitation a modem, a network card (wireless or wired), an infrared communication device, a wireless communication device, and/or a chipset such as a Bluetooth® device, an 802.11 device, a Wi-Fi device, a WiMAX™ device, cellular communication facilities, etc., and/or the like. The communications subsystem 630 may include one or more input and/or output communication interfaces to permit data to be exchanged with a network such as the network described below to name one example, other computer systems, television, and/or any other devices described herein. Depending on the desired functionality and/or other implementation concerns, a portable electronic device or similar device may communicate image and/or other information via the communications subsystem 630. In other embodiments, a portable electronic device, e.g. the first electronic device, may be incorporated into the computer system 600, e.g., an electronic device as an input device 615. In some embodiments, the computer system 600 will further comprise a working memory 635, which can include a RAM or ROM device, as described above.

The computer system 600 also can include software elements, shown as being currently located within the working memory 635, including an operating system 640, device drivers, executable libraries, and/or other code, such as one or more application programs 645, which may comprise computer programs provided by various embodiments, and/or may be designed to implement methods, and/or configure systems, provided by other embodiments, as described herein. Merely by way of example, one or more procedures described with respect to the methods discussed above, such as those described in relation to FIG. 6, might be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 625 described above. In some cases, the storage medium might be incorporated within a computer system, such as computer system 600. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by the computer system 600 and/or might take the form of source and/or installable code, which, upon compilation and/or installation on the computer system 600 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware, software including portable software, such as applets, etc., or both. Further, connection to other computing devices such as network input/output devices may be employed.

As mentioned above, in one aspect, some embodiments may employ a computer system such as the computer system 600 to perform methods in accordance with various embodiments of the technology. According to a set of embodiments, some or all of the procedures of such methods are performed by the computer system 600 in response to processor 610 executing one or more sequences of one or more instructions, which might be incorporated into the operating system 640 and/or other code, such as an application program 645, contained in the working memory 635. Such instructions may be read into the working memory 635 from another computer-readable medium, such as one or more of the storage device(s) 625. Merely by way of example, execution of the sequences of instructions contained in the working memory 635 might cause the processor(s) 610 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using the computer system 600, various computer-readable media might be involved in providing instructions/code to processor(s) 610 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 625. Volatile media include, without limitation, dynamic memory, such as the working memory 635.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 610 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 600.

The communications subsystem 630 and/or components thereof generally will receive signals, and the bus 605 then might carry the signals and/or the data, instructions, etc. carried by the signals to the working memory 635, from which the processor(s) 610 retrieves and executes the instructions. The instructions received by the working memory 635 may optionally be stored on a non-transitory storage device 625 either before or after execution by the processor(s) 610.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A weapon training system comprising:

a firing box including at least one processor;

a firing mechanism communicatively coupled with the firing box, wherein activation of the firing mechanism causes a simulated firing of a weapon;

a round sensor communicatively coupled with the firing box, the round sensor operable to be attached to or integrated with a round compatible with the weapon, wherein the round is operable to be inserted into a breech of the weapon; and a breech sensor communicatively coupled with the firing box, the breech sensor configured to detect an insertion of the round into the breech of the weapon via detection of the round sensor.

2. The weapon training system of claim 1, further comprising:

at least one charge sensor communicatively coupled with the firing box, the at least one charge sensor operable to be attached to or integrated with at least one charge compatible with the weapon, wherein the at least one charge is operable to be inserted into the breech of the weapon;

wherein the breech sensor is configured to detect an insertion of the at least one charge into the breech of the weapon via detection of the at least one charge sensor.

3. The weapon training system of claim 2, wherein detection of the at least one charge sensor is indicative of a charge quantity or a charge type associated with the at least one charge.

4. The weapon training system of claim 3, further comprising:

a speaker communicatively coupled with the firing box, wherein, in response to the activation of the firing mechanism causing the simulated firing of the weapon, the speaker is configured to output an audio signal, wherein the audio signal is dependent on one or more of the weapon, the round, the charge type, and the charge quantity.

5. The weapon training system of claim 1, further comprising:

an orientation sensor communicatively coupled with the firing box, the orientation sensor operable to be attached to or integrated with the weapon, the orientation sensor configured to determine an orientation of the weapon.

6. The weapon training system of claim 1, further comprising:

a Global Navigation Satellite System (GNSS) sensor communicatively coupled with the firing box, the GNSS sensor operable to be attached to or integrated with the weapon, the GNSS sensor configured to determine a geospatial position of the weapon.

7. The weapon training system of claim 1, further comprising:

an evaluator device communicatively coupled with the firing box, the evaluator device configured to display an analysis of a training protocol associated with the simulated firing of the weapon, the analysis of the training protocol including one or more of:

an indication that the firing mechanism was activated;

an indication that the simulated firing of the weapon occurred;

an indication that each of one or more requirements of the training protocol were met; and an indication that one or more requirements of the training protocol were not met.

8. The weapon training system of claim 1, further comprising:

a fuse setter communicatively coupled with one or both of the firing box and the round sensor, the fuse setter configured to modify a fuse setting associated with a fuse of the round.

9. The weapon training system of claim 1, wherein the firing mechanism comprises one or more of: a button, a knob, a switch, a lever, a pull cord, and a touch screen.

10. The weapon training system of claim 1, wherein the firing mechanism is integrated with the firing box, and wherein the firing box is operable to be attached to the weapon.

11. The weapon training system of claim 1, wherein the breech sensor is integrated with the firing box, and wherein the firing box is operable to be attached to the weapon within a threshold distance of the breech of the weapon.

12. A weapon training system comprising:

a weapon comprising a breech in which a round compatible with the weapon may be inserted;

a firing box including at least one processor;

a firing mechanism communicatively coupled with the firing box, wherein activation of the firing mechanism causes a simulated firing of the weapon;

a round sensor communicatively coupled with the firing box, the round sensor operable to be attached to or integrated with the round; and a breech sensor communicatively coupled with the firing box, the breech sensor configured to detect an insertion of the round into the breech of the weapon via detection of the round sensor.

13. The weapon training system of claim 12, further comprising:

at least one charge sensor communicatively coupled with the firing box, the at least one charge sensor operable to be attached to or integrated with at least one charge compatible with the weapon, wherein the at least one charge is operable to be inserted into the breech of the weapon;

wherein the breech sensor is configured to detect an insertion of the at least one charge into the breech of the weapon via detection of the at least one charge sensor.

14. The weapon training system of claim 13, wherein detection of the at least one charge sensor is indicative of a charge quantity or a charge type associated with the at least one charge.

15. The weapon training system of claim 14, further comprising:

a speaker communicatively coupled with the firing box, wherein, in response to the activation of the firing mechanism causing the simulated firing of the weapon, the speaker is configured to output an audio signal, wherein the audio signal is dependent on one or more of the weapon, the round, the charge type, and the charge quantity.

16. The weapon training system of claim 12, further comprising:

an orientation sensor communicatively coupled with the firing box, the orientation sensor operable to be attached to or integrated with the weapon, the orientation sensor configured to determine an orientation of the weapon.

17. The weapon training system of claim 12, further comprising:

a Global Navigation Satellite System (GNSS) sensor communicatively coupled with the firing box, the GNSS sensor operable to be attached to or integrated with the weapon, the GNSS sensor configured to determine a geospatial position of the weapon.

18. The weapon training system of claim 12, further comprising:

an evaluator device communicatively coupled with the firing box, the evaluator device configured to display an analysis of a training protocol associated with the simulated firing of the weapon, the analysis of the training protocol including one or more of:

an indication that the firing mechanism was activated;

an indication that the simulated firing of the weapon occurred;

an indication that each of one or more requirements of the training protocol were met; and an indication that one or more requirements of the training protocol were not met.

19. The weapon training system of claim 12, further comprising:

a fuse setter communicatively coupled with one or both of the firing box and the round sensor, the fuse setter configured to modify a fuse setting associated with a fuse of the round.

20. The weapon training system of claim 12, wherein the firing mechanism comprises one or more of: a button, a knob, a switch, a lever, a pull cord, and a touch screen.

* * * * *